US008616381B1

(12) United States Patent
Forster et al.

(10) Patent No.: US 8,616,381 B1
(45) Date of Patent: Dec. 31, 2013

(54) CANTILEVER CAROUSEL SYSTEM

(75) Inventors: Phillip G. Forster, Arborg (CA); Stanley K. Plett, Arborg (CA)

(73) Assignee: Vidir Machines, Inc., Arborg, Manitoba (CA)

( * ) Notice: Subject to any disclaimer, the term of this patent is extended or adjusted under 35 U.S.C. 154(b) by 1158 days.

(21) Appl. No.: 12/511,105

(22) Filed: Jul. 29, 2009

(51) Int. Cl.
*A47F 3/08* (2006.01)
*A47F 5/02* (2006.01)
*A47B 49/00* (2006.01)

(52) U.S. Cl.
USPC ..... 211/1.56; 211/121; 312/97.1; 312/267; 198/347.2; 101/479; 101/480

(58) Field of Classification Search
USPC ..... 211/1.51, 1.52, 1.53, 1.54, 1.55, 1.56, 211/121; 32/97, 97.1, 134, 266, 267, 268; 242/594.2–594.6, 597, 597.1, 597.2; 198/347.1, 347.2; 101/216, 479, 480
See application file for complete search history.

(56) References Cited

U.S. PATENT DOCUMENTS

| | | | | | |
|---|---|---|---|---|---|
| 404,480 | A | | 6/1889 | Harrington et al. | |
| 637,580 | A | * | 11/1899 | Hett | 101/479 |
| 643,049 | A | | 2/1900 | Feeser | |
| 1,030,376 | A | * | 6/1912 | Baecker | 312/134 |
| 1,744,996 | A | | 1/1930 | Ward | |
| 3,223,247 | A | | 12/1965 | Bleed | |
| 3,874,496 | A | | 4/1975 | Bodin | |
| 4,026,617 | A | | 5/1977 | Bosio et al. | |
| 4,284,206 | A | | 8/1981 | Wittern | |
| 4,312,550 | A | | 1/1982 | Jackson | |
| 4,779,938 | A | * | 10/1988 | Johnston | 312/134 |
| 5,031,847 | A | * | 7/1991 | Tanaka | 242/417.3 |
| 5,285,981 | A | * | 2/1994 | Pavelka | 242/557 |
| 5,310,066 | A | | 5/1994 | Konstant | |
| 5,316,232 | A | * | 5/1994 | Lambert, Jr. | 242/422.4 |
| 5,339,968 | A | | 8/1994 | Voelz | |
| 5,431,493 | A | | 7/1995 | Larson | |
| 6,847,861 | B2 | | 1/2005 | Lunak et al. | |
| 6,918,732 | B2 | * | 7/2005 | Jendroska et al. | 414/331.14 |
| 7,290,488 | B2 | * | 11/2007 | Petersen et al. | 101/479 |
| 7,370,581 | B2 | * | 5/2008 | Plasswich et al. | 101/477 |
| 7,543,531 | B2 | * | 6/2009 | Blanchard et al. | 101/216 |
| 8,141,239 | B2 | * | 3/2012 | Rogge | 29/809 |
| 2002/0056392 | A1 | * | 5/2002 | Sameit et al. | 101/484 |
| 2002/0129720 | A1 | * | 9/2002 | Jendroska et al. | 101/216 |
| 2003/0047094 | A1 | * | 3/2003 | Niemiro et al. | 101/216 |
| 2008/0134919 | A1 | * | 6/2008 | Jendroska et al. | 101/479 |

FOREIGN PATENT DOCUMENTS

| | | | | |
|---|---|---|---|---|
| DE | 4239731 | A1 | * | 6/1994 |
| WO | WO 2008043714 | A1 | * | 4/2008 |

* cited by examiner

*Primary Examiner* — Joshua Rodden
(74) *Attorney, Agent, or Firm* — Neustel Law Offices

(57) ABSTRACT

A cantilever carousel system for efficiently storing multiple print cylinders while providing a common access point for loading and unloading the print cylinders. The cantilever carousel system generally includes an external frame structure defining an internal cavity and a shell connected to the external frame structure to surround the cavity, wherein the shell includes at least one access opening extending therethrough. An internal frame structure is positioned within the cavity and a vertically oriented carousel is supported by the internal frame structure. A drive assembly is mechanically connected to the carousel, wherein the drive assembly circulates the carousel and a plurality of cantilever mandrels are supported by the carousel and circulate with the carousel. A plurality of print cylinders are removably received by the plurality of cantilever mandrels through the access opening.

14 Claims, 6 Drawing Sheets

CANTILEVER CAROUSEL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to print cylinder storage and more specifically it relates to a cantilever carousel system for efficiently storing multiple print cylinders while providing a common access point for loading and unloading the print cylinders.

2. Description of the Related Art

Any discussion of the related art throughout the specification should in no way be considered as an admission that such related art is widely known or forms part of common general knowledge in the field.

Print cylinders for applying die to various mediums, such as newspapers, magazines, food wrappers, or various other mediums have been in use for years. Generally, print cylinders are stored on large stationary storage racks during periods of non use. It can be difficult to load or unload the print cylinders from the storage rack due to the height of the storage rack.

Because the storage racks are stationary, which forces the user to access print cylinders high above the floor surface, the storage racks are often built closer to the floor surface and thus comprise a shorter overall structure. Thus, the need for wider storage racks is necessary which can take up valuable floor space. Because of the inherent problems with the related art, there is a need for a new and improved cantilever carousel system for efficiently storing multiple print cylinders while providing a common access point for loading and unloading the print cylinders.

BRIEF SUMMARY OF THE INVENTION

A system for efficiently storing multiple print cylinders while providing a common access point for loading and unloading the print cylinders. The invention generally relates to print cylinder storage which includes an external frame structure defining an internal cavity and a shell connected to the external frame structure to surround the cavity, wherein the shell includes at least one access opening extending therethrough. An internal frame structure is positioned within the cavity and a vertically oriented carousel is supported by the internal frame structure. A drive assembly is mechanically connected to the carousel, wherein the drive assembly circulates the carousel and a plurality of cantilever mandrels are supported by the carousel and circulate with the carousel. A plurality of print cylinders are removably received by the plurality of cantilever mandrels through the access opening.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
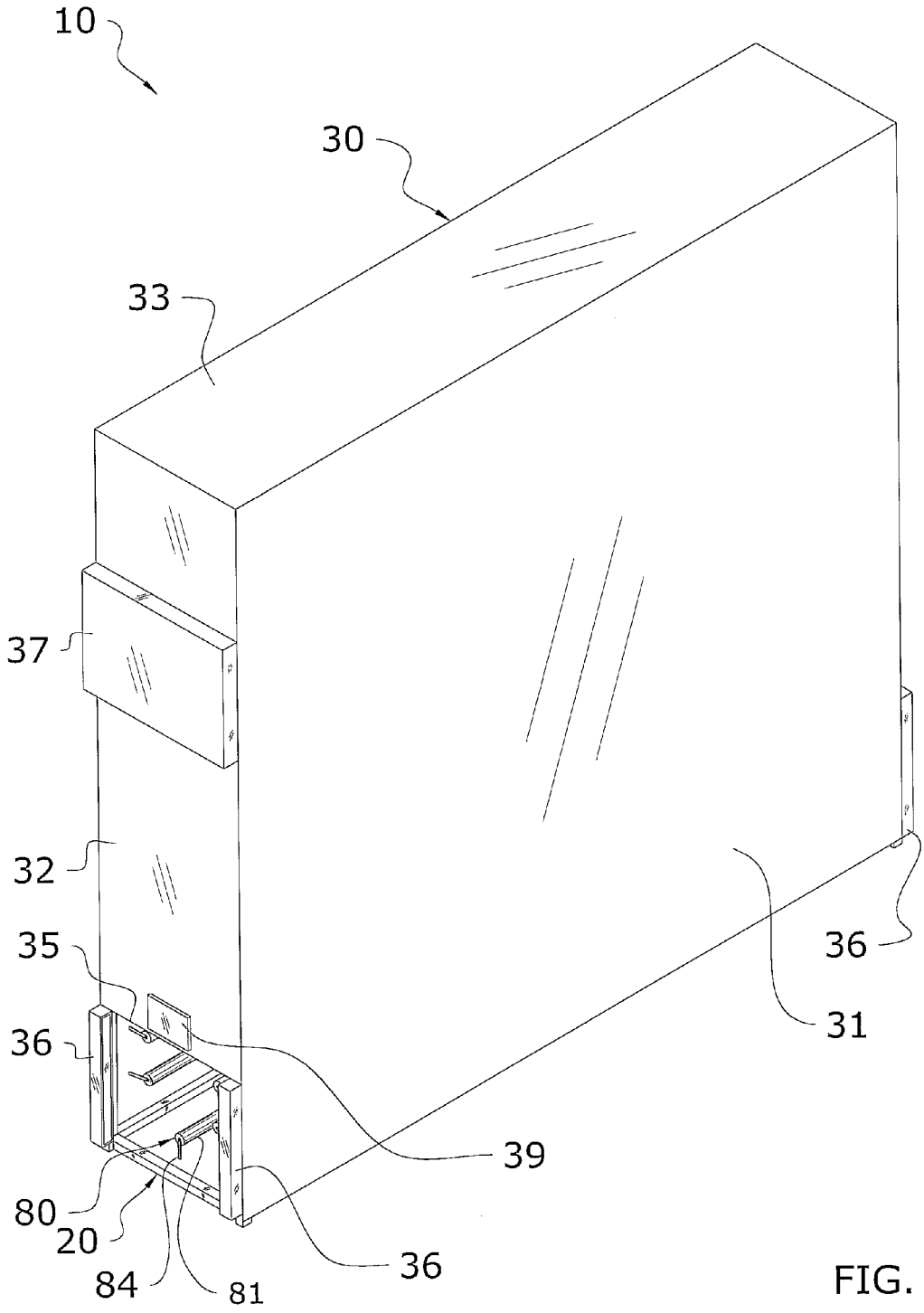
FIG. 1 is an upper perspective view of the present invention.

A. Overview.

Turning now descriptively to the drawings, in which similar reference characters denote similar elements throughout the several views, FIGS. 1 through 6 illustrate a cantilever carousel system 10, which comprises an external frame structure 20 defining an internal cavity 29 and a shell 30 connected to the external frame structure 20 to surround the cavity 29, wherein the shell 30 includes at least one access opening 35 extending therethrough. An internal frame structure 40 is positioned within the cavity 29 and a vertically oriented carousel 60 is supported by the internal frame structure 40. A drive assembly 50 is mechanically connected to the carousel 60, wherein the drive assembly 50 circulates the carousel 60 and a plurality of cantilever mandrels 80 are supported by the carousel 60 and circulate with the carousel 60.

A plurality of print cylinders 12 are removably received by the plurality of cantilever mandrels 80 through the access opening 35. The print cylinders 12 are generally comprised of hollow structures to receive the cantilever mandrels 80 and also generally include a printing die to be used in a printing process. It is appreciated that other types of open ended cylindrical devices or structures may be used rather than the print cylinders 12.

B. External Frame Structure.

The present invention includes an external frame structure 20 which supports the shell 30 and serves as a protective barrier for users around the circulating carousel 60. The external frame structure 20 is generally comprised of a strong rigid material, such as metal, unless otherwise noted. The external frame structure 20 also generally resembles a tower in structure, wherein the external frame structure 20 extends in a general vertical direction from the floor surface and is oriented vertically to encompass the carousel 60.

The external frame structure 20 is generally box-like in shape and includes a front and rear vertical members 21, 23, front and rear horizontal members 22, 24, and cross members 25 connecting the front and rear vertical members 21, 23. Some of the cross members 25 along each end of the external frame structure 20 define access openings 35. Each of the members 21-25 are generally comprised of a square cross-sectional shape and are elongated; however the members 21-25 may take the form of various shapes.

The external frame structure 20 also includes a plurality of cross supports 27 for securing the drive assembly 50 thereon. The drive assembly 50 is preferably supported and secured near the outer edge of the external frame structure 20 to be easily accessible for repairs and maintenance. The external frame structure 20 defines a cavity 29 within for positioning the internal frame structure 40, carousel 60 and cantilever mandrels 80 which also support the print cylinders 12.

C. Shell.

A shell 30 generally surrounds the external frame structure 20 for providing protection for operators and nearby objects from coming into contact with the circulating carousel 60 and cantilever mandrels 80 and likewise to protect the print cylinders 12 stored upon the cantilever mandrels 80. The shell 30 is generally comprised of a thin plate-like material and includes sidewalls 31, end walls 32 and a top 33 to encompass the external frame structure 20.

Each of the end walls 32 also generally include an access opening 35 adjacent the floor surface for accessing the lower most print cylinders 12 upon the lower most cantilever mandrels 80 from each side of the shell 30. The access openings 35 are cut within the end walls 32 and defined by some of the cross members 25. The access openings 35 are large enough for the print cylinders 12 upon the lower most cantilever mandrels 80 to be easily removed from within the external frame structure 20. A first access opening 35 along one end wall 32 is used to access a first portion 81 of a cantilever mandrel 80 and an opposite access opening 35 along a second end wall 32 is used to access a second portion 82 of the cantilever mandrel 80 to load respective first and second print cylinders 12 thereupon.

The shell 30 also generally includes at least one access panel 37 for accessing the drive assembly 50 for repairs and maintenance. The drive assembly 50 is generally aligned with the upper sprockets 62, 67 of the carousel 60 to rotate and drive the upper sprockets 62, 67 which in turn rotate and drive the lower sprockets 63, 68. The access panel 37 preferably conceals the drive assembly 50 to reduce noise and also protect the drive assembly 50 during use and is openable via various manners to allow inspection of the drive assembly 50 if needed.

On respective sides of each of the access openings 35 are sensor units 36. The sensor units 36 work collectively to stop the carousel 60 from circulating if an object or individual passes through the access opening 35. The sensor units 36 may be comprised of various types of sensors all which detect movement or the presence of an individual or object in the access opening 35 or cavity 29 and are capable of sending a signal to the controller 39 to stop the circulation of the carousel 60.

D. Controller.

The present invention also includes a controller 39 preferably positioned proximate the present invention and further preferably located along one of the walls 31, 32 of the shell 30 along an external surface. The controller 39 is used to control the drive assembly 50 and carousel 60 along with other electrical components (e.g. lights) of the present invention. The controller 39 may include various LCD displays along with multiple controls.

E. Drive Assembly.

The drive assembly 50 generally includes a motor 51, which may be comprised of an electric, gas, hydraulic, or other type, connected to a gearbox 54 through an elongated member 52 such as a chain or belt. The motor 51 and the gearbox 54 are preferably supported via cross supports 27 upon the external frame structure 20 adjacent one of the end walls 32 and the access panel 37. As the motor 51 drives the gearbox 54, the gearbox 54 rotates an elongated shaft 55 extending therefrom towards the internal frame structure 40 and carousel 60.

An opposite end of the shaft 55 is connected to a sprocket 56, which in turn is connected to another sprocket 58 via an elongated member 57, such as a chain or belt. The sprocket 58 is coupled to the primary sprocket 62 of the first carrier assembly 61 to rotate the primary sprocket 62 and circulate the first carrier assembly 61 and connected second carrier assembly 66 of the carousel 60.

F. Internal Frame Structure.

The present invention also preferably includes an internal frame structure 40 positioned internally of the external frame structure 20 for supporting the carousel 60. The internal frame structure 40 is preferably vertically oriented within the cavity 29 of the external frame structure 20 and centered therein. The internal frame structure 40 thus generally extends from a lower end to an upper end of the external frame structure 20 to allow for a maximum number of cantilever mandrels 80 to be supported therefrom.

The internal frame structure 40 includes a plurality of first vertical members 41 for supporting the first carrier assembly 61 of the carousel 60 and a plurality of second vertical members 42 for supporting the second carrier assembly 66 of the carousel 60. Cross members connect the first vertical members 41 to the second vertical members 42 for adding support thereto and connecting supports 45 connect the internal frame structure 40 to the external frame structure 20. It is appreciated that the internal frame structure 40 is generally suspended above the floor surface via the connecting supports 45 (e.g. beams, etc.) connecting the internal frame structure 40 to the external frame structure 20.

G. Carousel.

Figure 2:
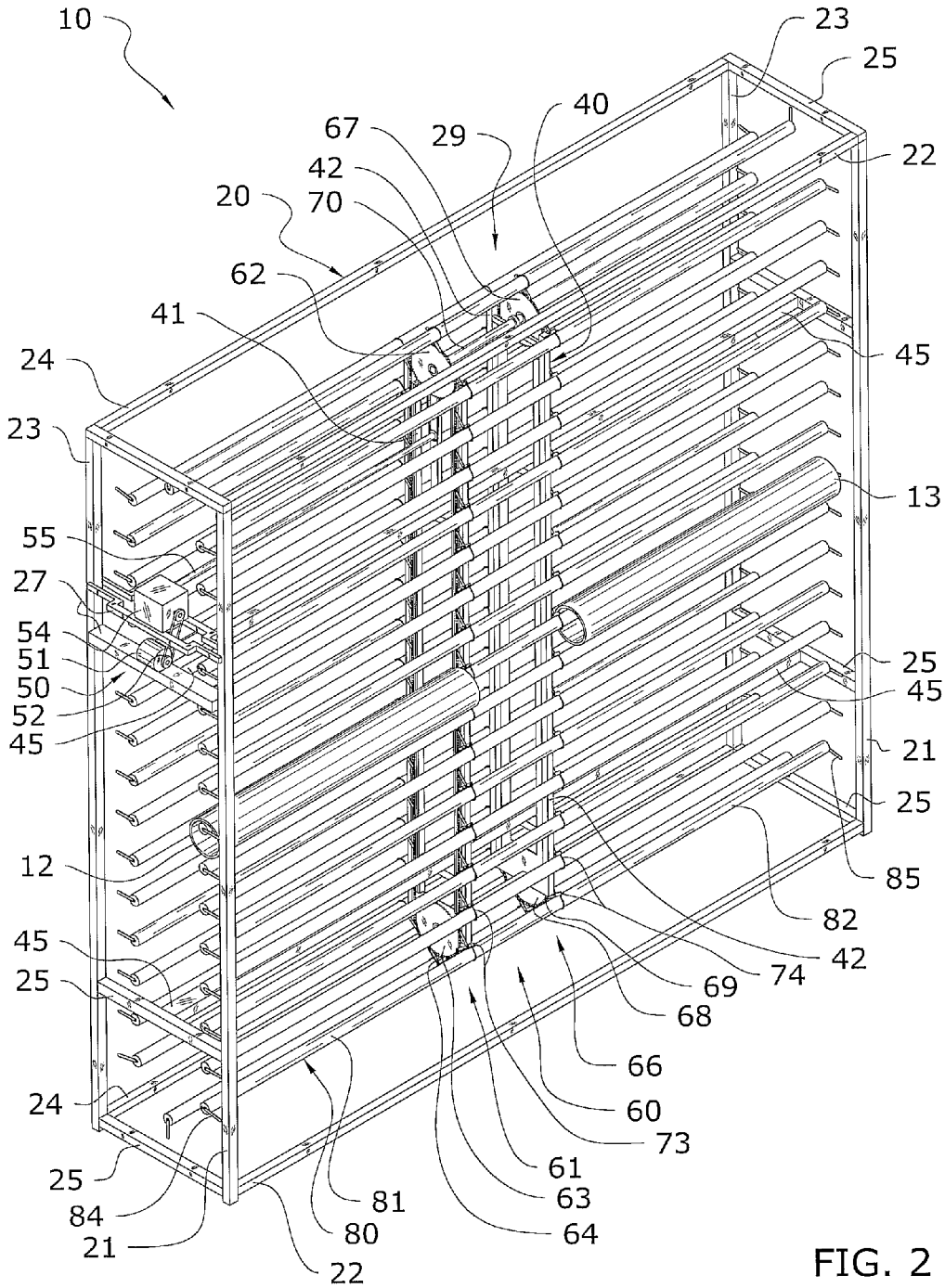
FIG. 2 is an upper perspective view of the present invention with the shell removed.
Figure 3:
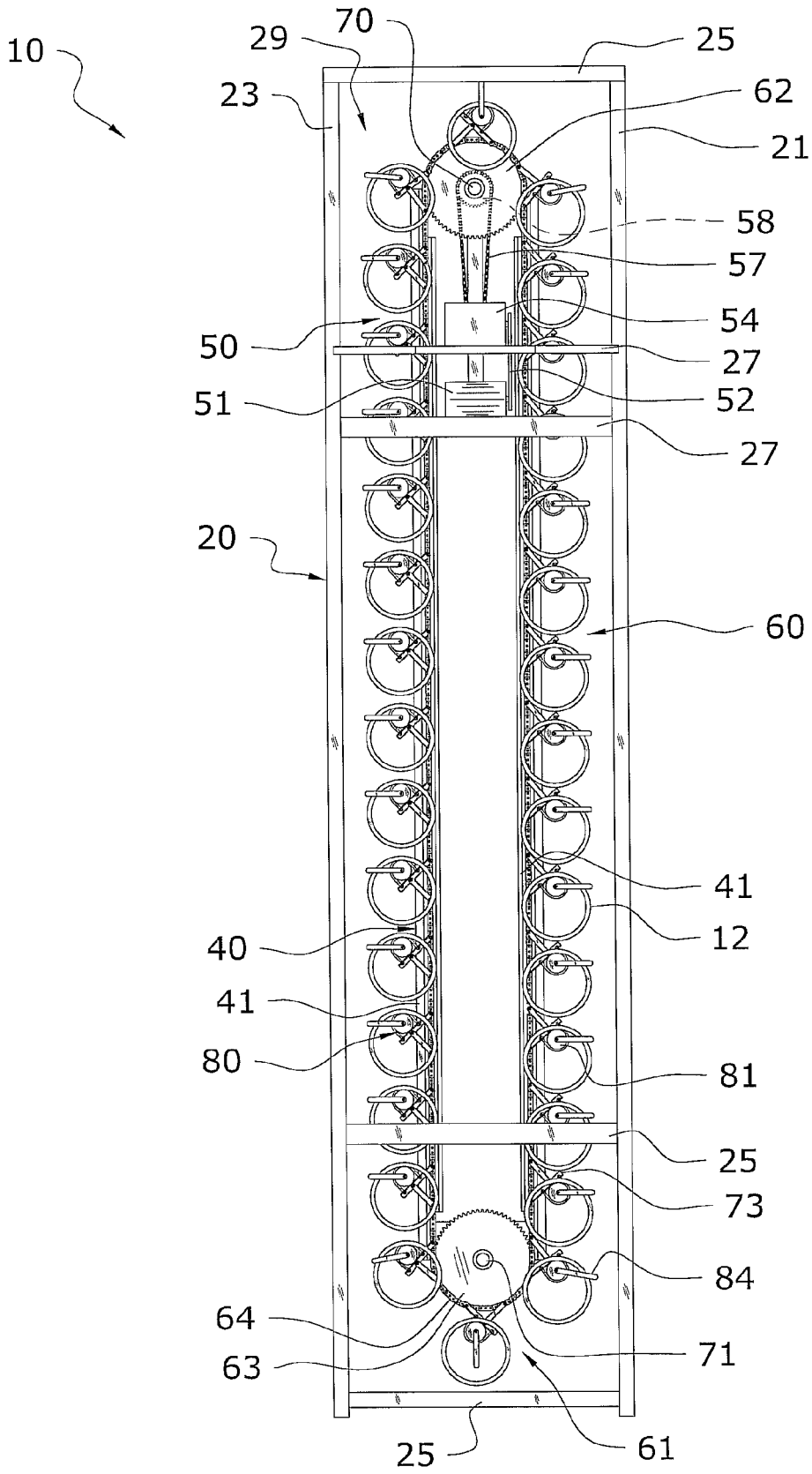
FIG. 3 is a side view of the present invention with the shell removed and a plurality of print cylinders positioned upon the cantilever mandrels.
Figure 4:
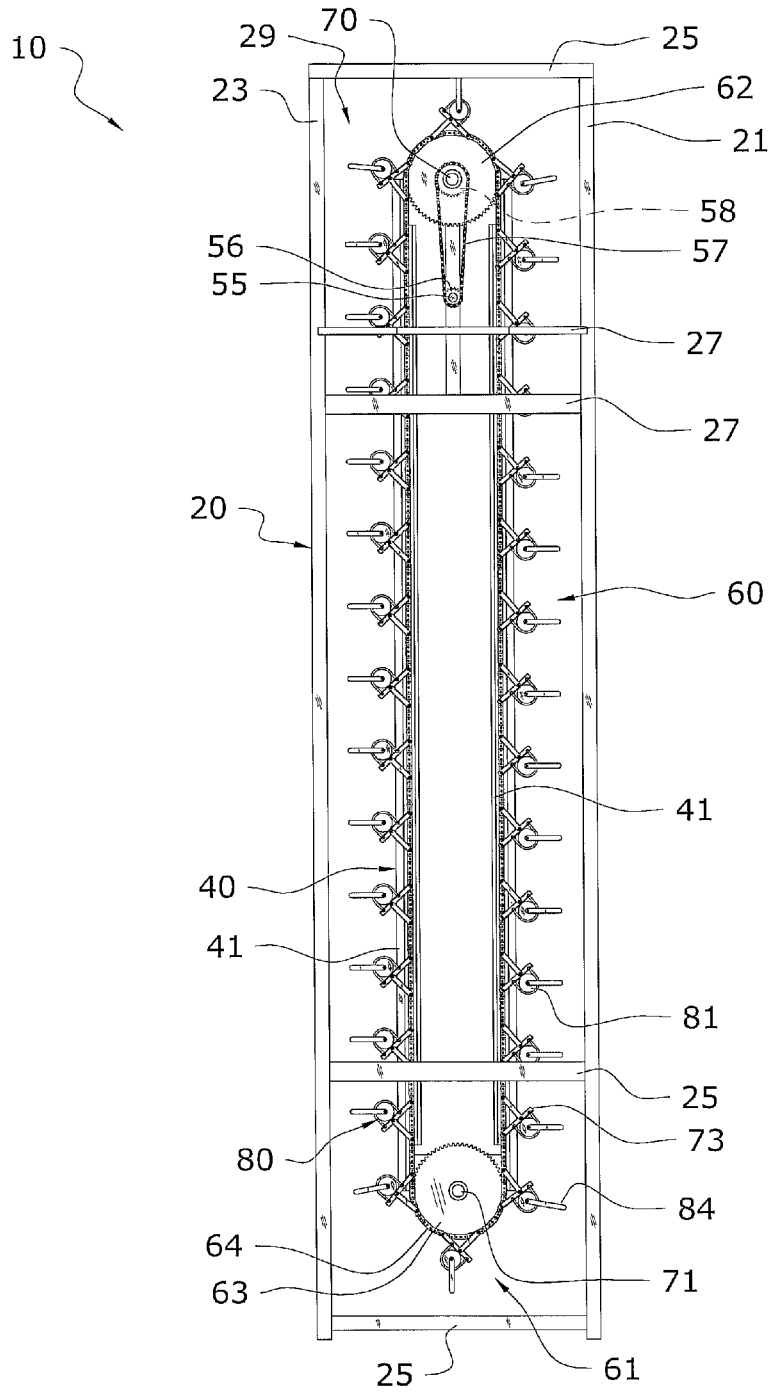
FIG. 4 is a side view of the present invention with the shell removed.
Figure 5:
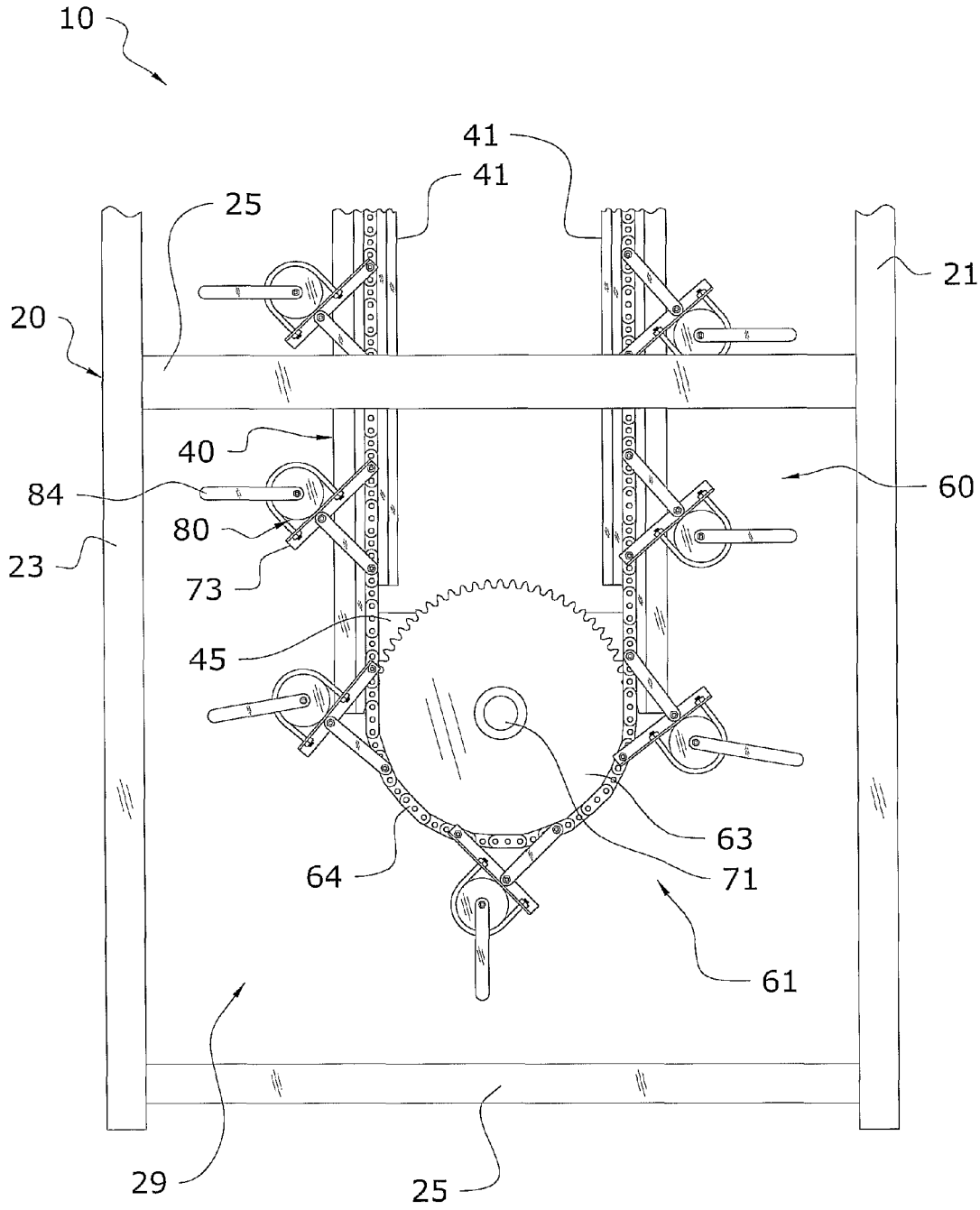
FIG. 5 is a magnified side view of the lower end of the present invention with the shell removed.
Figure 6:
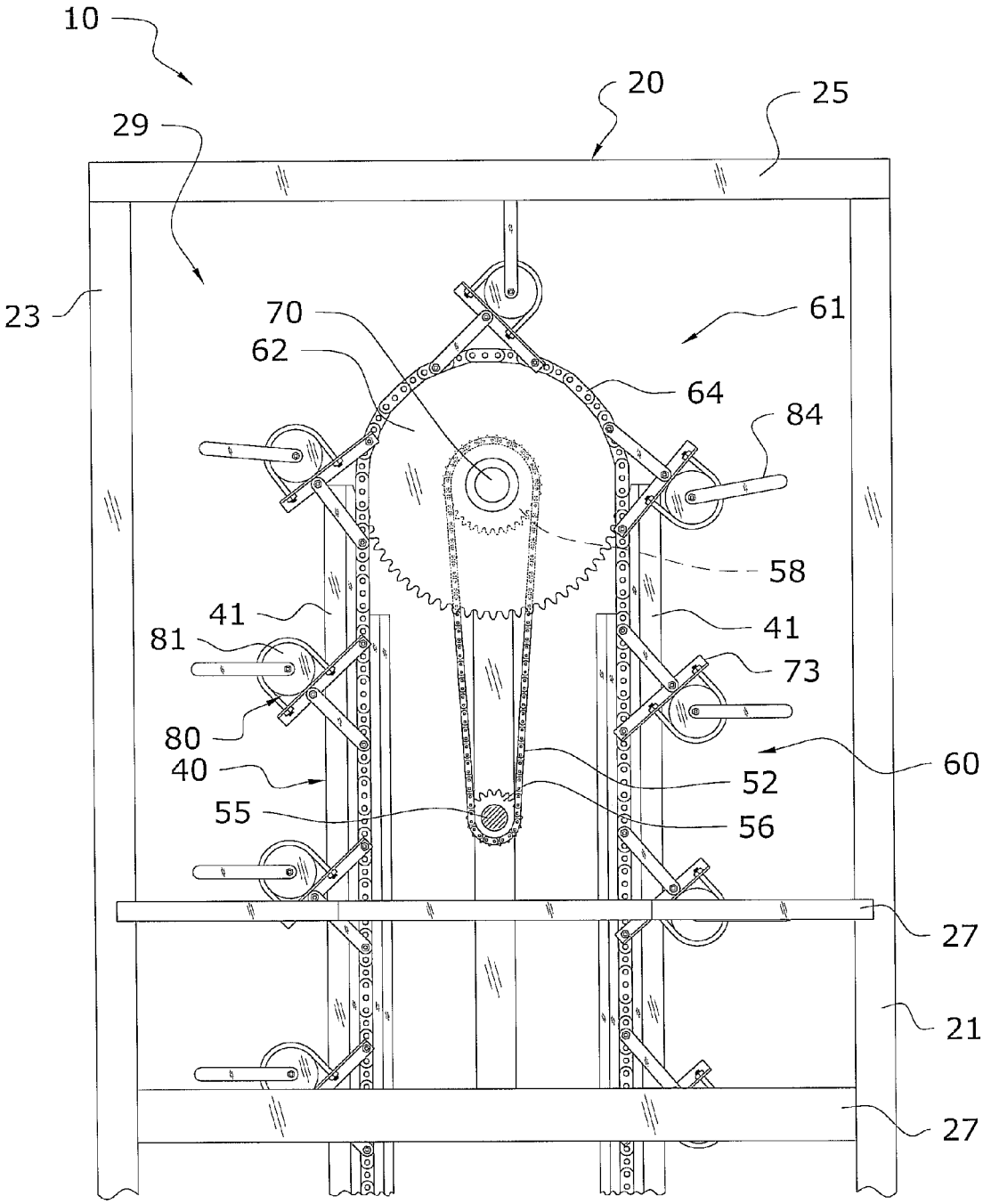
FIG. 6 is a magnified side view of the upper end of the present invention with the shell removed.

The carousel 60 is supported by the internal frame structure 40 and circulates about the internal frame structure 40 and thus likewise circulates within the cavity 29 and about the external frame structure 20. The carousel 60 generally circulates in a vertically oriented manner wherein the carousel 60 travels substantially further in length in a vertical direction than in a horizontal direction. As shown in FIGS. 2 through 6 of the drawings, the carousel 60 includes a first vertical run and a second vertical run, wherein the first vertical run moves downwardly when the second vertical run moves upwardly. As shown in FIGS. 2 and 3 of the drawings, the carousel 60 is comprised of an elongated member, wherein the elongated member is an endless loop structure. It is appreciated that in locations with low ceilings or limited vertical space, a horizontally oriented carousel 60 and correspondingly oriented frame structures 20, 40 may be used.

The carousel 60 preferably has a first carrier assembly 61 and a second carrier assembly 66 for supporting the cantilever mandrels 80 near a longitudinal center. It is appreciated that more or less carrier assemblies may be used depending on the length and amount of cantilever mandrels 80. For example, when less cantilever mandrels 80 or shorter cantilever mandrels 80 are used, only one carrier assembly may be needed to provide adequate support to the cantilever mandrels 80. The first carrier assembly 61 and the second carrier assembly 66 rotate together and simultaneously. The first carrier assembly 61 and the second carrier assembly 66 are also comprised of a loop structure to operate in an endless circulating manner.

Each carrier assembly 61, 66 is comprised of a chain and sprocket structure and generally includes a drive sprocket 62, 67 preferably located at an upper end of the carrier assemblies 61, 66 and a secondary sprocket 63, 68 preferably located at a lower end. The drive sprocket 62 and the secondary sprocket 63 of the first carrier assembly 61 are connected via an elongated member 64 and the drive sprocket 67 and the secondary sprocket 68 of the second carrier assembly 66 are connected by a separate elongated member 69. The elongated members 64, 69 may be comprised of chains, pulleys, or various other types. Likewise, the sprockets 62, 63, 67, 68 may be comprised of gear shaped sprockets, pulleys, or various other types.

The drive sprockets 62, 67 of the first carrier assembly 61 and the second carrier assembly 66 are rotatably coupled via a connecting shaft 70 which also is connected to the sprocket 58 mechanically connected to the shaft 55 of the gearbox 54. It is appreciated that only one connecting shaft 70 is necessary in the case of a single drive assembly 50 as shown in the present invention, wherein each of the carrier assemblies 61, 66 operate simultaneously.

Each of the carrier assemblies 61, 66 also include a plurality of clamps 73, 74. The clamps 73, 74 are fixed to a respective elongated member 64, 69 and circulate with the elongated member 64, 69. The clamps 73, 74 also thus rotate as the elongated member 64, 69 changes directions, such as when moving around the lower end or the upper end of the carrier assembly 61, 66. The clamps 73, 74 are preferably comprised of a U-shaped clamp and are tightenable upon the cantilever mandrels 80 to secure the cantilever mandrels 80 to the carousel 60. The clamps 73, 74 preferably tighten the cantilever mandrels 80 upon the elongated member 64, 69 of the carousel 60 in a manner that prevents the cantilever mandrels 80 from rotating freely and forces the cantilever mandrels 80 to rotate with the clamps 73, 74 as the clamps 73, 74 are circulated with the elongated members 64, 69.

H. Cantilever Mandrels.

The present invention includes a plurality of cantilever mandrels 80 each for supporting at least one of the print cylinders 12 thereupon. The cantilever mandrels 80 are generally comprised of elongated tubular structures that extend the entire length of the cavity 29 of the external frame structure 20. The cantilever mandrels 80 are secured near a center of their longitudinal axis by the carousel 60 so that print cylinders 12 may be positioned upon a defined first portion 81 and second portion 82 of the cantilever mandrels 80. The first portion 81 and the second portion 82 are defined lengthwise by the carousel 60 and are accessible from respective end access openings 35. It is appreciated that instead of a first portion 81 and a second portion 82 to receive two separate print cylinders 12 each from an opposite end, the use of two cantilever mandrels 80 may linearly aligned with one another may be sufficient. The cantilever structure of the mandrels 80 is important to allow easy loading and unloading of the print cylinders 12 thereupon.

Each of the cantilever mandrels 80 also includes a retaining bracket 84, 85 extending from each end of the cantilever mandrels 80. The retaining bracket 84, 85 holds the respective print cylinders 12 upon cantilever mandrels 80 by extending over an outer end of the print cylinders 12. The retaining bracket 84, 85 is preferably comprised of an L-shaped structure. The retaining bracket 84, 85 also rotates with the cantilever mandrels 80 as the cantilever mandrels 80 are circulated about the carousel 60.

When respective cantilever mandrels 80 are moving substantially in a vertical direction, the retaining brackets 84, 85 extend in a general horizontal orientation which allows the retaining bracket 84, 85 to extend laterally past the outer end of the respective print cylinder 12 so as to retain the print cylinder 12 upon the cantilever mandrel 80. When the cantilever mandrels 80 are moving substantially in a horizontal direction, the retaining bracket 84, 85 extend in a general vertical orientation (via being rotated) which prevents the retaining bracket 84, 85 from extending past the outer end of the respective print cylinder 12 so as to allow the print cylinder 12 to be removed from the cantilever mandrel 80.

I. Operation of Preferred Embodiment.

In use, a first print cylinder 12 is positioned upon a lower most cantilever mandrel 80 upon a first portion 81 of the cantilever mandrel 80 so as to be retained by a respective first clamp 73 attached to the cantilever mandrel 80 and positioned near an inner end of the first print cylinder 12 and the other end positioned inwardly of a respective retaining bracket 84. Likewise, another print cylinder 12 is positioned upon the lower most cantilever mandrel 80 upon a second portion 82 of the cantilever mandrel 80 in a similar manner. The first print cylinder 12 is positioned upon the first portion 81 of the cantilever mandrel 80 via extending the first print cylinder 12 through access opening 35 on a respective end and the other print cylinder 12 is positioned upon the second portion 82 of the cantilever mandrel 80 via extending the second print cylinder 12 through access opening 35 on an opposite end of the shell 30 and external frame structure 20.

The controller 39 is then operated to circulate the carousel 60 so that another cantilever mandrel 80 moves to the lowermost position and a respective pair of retaining brackets 84, 85 move to a vertical position so that another first and second print cylinder 12 may be slid upon the new lowermost cantilever mandrel 80. It is appreciated that the previously loaded first and second print cylinder 12 are now circulated slightly in an upward direction causing the respective retaining brackets 84, 85 to move laterally across an outer end of the first and second print cylinders 12 to retain the first and second print cylinders 12 upon the first and second portion 81, 82 of the cantilever mandrels 80.

The carousel 60 is continued to be circulated until each of the cantilever mandrels 80 have a print cylinder 12 upon both a first portion 81 and a second portion 82 of the cantilever mandrel 80. It is appreciated that the preferred manner in which the cantilever mandrel 80 is circulated is the motor 51 causing the gearbox 54 to rotate the shaft 55 which in turn transfers rotational force to the drive sprocket 62 of the first carrier assembly 61 through the mechanically connected sprockets 56, 58 and elongated member 57. The rotation of the drive sprocket 62 of the first carrier assembly 61 causes the entire first carrier assembly 61 and the second carrier assembly 66 to circulate thus circulating the attached cantilever mandrels 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A cantilever carousel system for storing print cylinders, comprising:

a frame structure;

a carousel supported by said frame structure, wherein said carousel is vertically oriented;

a drive assembly mechanically connected to said carousel, wherein said drive assembly circulates said carousel about said frame structure; and a plurality of cantilever mandrels supported by said carousel, wherein said plurality of cantilever mandrels circulate with said carousel;

wherein said plurality of cantilever mandrels each removably receive a print cylinder thereon;

an external frame structure to surround said plurality of cantilever mandrels and said carousel;

wherein said external frame structure includes a shell;

wherein said shell includes at least one access opening for accessing a lowermost cantilever mandrel of said plurality of cantilever mandrels;

a sensor unit positioned proximate said at least one access opening to detect movement through said at least one access opening.

2. The cantilever carousel system of claim 1, including a controller for activating said drive assembly to circulate said carousel.

3. The cantilever carousel system of claim 1, wherein said carousel includes a first carrier assembly and a second carrier assembly.

4. The cantilever carousel system of claim 3, wherein said first carrier assembly and said second carrier assembly circulate simultaneously.

5. The cantilever carousel system of claim 4, wherein said first carrier assembly and said second carrier assembly are both comprised of a sprocket and chain structure.

6. The cantilever carousel system of claim 1, wherein each of said plurality of cantilever mandrels includes at least one retaining bracket extending from an outer end.

7. A cantilever carousel system for storing print cylinders, comprising:

an external frame structure defining an internal cavity;

a shell connected to said external frame structure to surround said cavity;

wherein said shell includes a first access opening extending through a first end wall and a second access opening extending through a second end wall, wherein said first end wall is opposite said second end wall;

wherein said shell has a sensor unit positioned proximate each of said first access opening and said second access opening for detecting movement therethrough;

an internal frame structure positioned within said cavity;

wherein said internal frame structure is connected to said external frame structure and wherein said internal frame structure is suspended above a floor surface;

a carousel supported by said internal frame structure within said cavity and above said floor surface;

wherein said carousel is vertically oriented;

a drive assembly to circulate said carousel about said internal frame structure;

wherein said drive assembly is supported by said external frame structure;

wherein said drive assembly is accessible via an access panel of said external frame structure;

wherein said drive assembly includes a motor and a gearbox;

wherein said gearbox is mechanically connected to said carousel;

wherein said carousel includes a first carrier assembly and a second carrier assembly which operate simultaneously;

wherein said first carrier assembly is comprised of a first chain and sprocket structure and wherein said second carrier assembly is comprised of a second chain and sprocket structure;

wherein said first carrier assembly is coupled to said second carrier assembly;

a plurality of cantilever mandrels supported by said carousel within said cavity, wherein said plurality of cantilever mandrels circulate with said carousel;

wherein said first carrier assembly includes a plurality of first clamps and wherein said second carrier assembly includes a plurality of second clamps, wherein said first clamps and said second clamps cooperatively connect to said plurality of cantilever mandrels;

wherein each of said plurality of cantilever mandrels includes a first retaining bracket and a second retaining bracket extending from respective ones of opposing ends;

wherein said plurality of cantilever mandrels each include a first portion and a second portion defined along a longitudinal length of said plurality of cantilever mandrels;

wherein the first portion of said plurality of cantilever mandrels is accessible through said first access opening and wherein said second portion of said plurality of cantilever mandrels is accessible through said second access opening; and a plurality of print cylinders removably received by said plurality of cantilever mandrels through said first access opening and said second access opening;

wherein said first retaining bracket and said second retaining bracket are substantially horizontally oriented when travelling in a vertical direction to retain said plurality of print cylinders upon said plurality of cantilever mandrels;

wherein said first retaining bracket and said second retaining bracket are substantially vertically oriented when travelling in a horizontal direction to allow removal of said plurality of print cylinders from said plurality of cantilever mandrels.

8. The cantilever carousel system of claim 2, wherein said controller stops the circulation of said carousel if movement is detected by said sensor unit.

9. The cantilever carousel system of claim 1, wherein said carousel has a vertical height and a horizontal width, wherein said vertical height is greater than said horizontal width.

10. The cantilever carousel system of claim 1, wherein said carousel includes a first vertical run and a second vertical run, wherein said first vertical run moves downwardly when said second vertical run moves upwardly.

11. The cantilever carousel system of claim 10, wherein said first vertical run is parallel with respect to said second vertical run.

12. The cantilever carousel system of claim 11, wherein said first vertical run is near said second vertical run.

13. The cantilever carousel system of claim 1, wherein said carousel is comprised of an elongated member, wherein said elongated member is an endless loop structure.

14. The cantilever carousel system of claim 10, wherein said plurality of cantilever mandrels are comprised of a first mandrel group and a second mandrel group, wherein said first mandrel group is attached to said first vertical run and wherein said second mandrel group is attached to said second vertical run, wherein said first mandrel group is vertically aligned and wherein said second mandrel group is vertically aligned.

* * * * *